US011773769B2

(12) United States Patent
Chown et al.

(10) Patent No.: US 11,773,769 B2
(45) Date of Patent: Oct. 3, 2023

(54) PISTON FOR AN OPPOSED-PISTON ENGINE

(71) Applicant: Achates Power, Inc., San Diego, CA (US)

(72) Inventors: Daniel M. Chown, Reno, NV (US); Ryan G. MacKenzie, San Diego, CA (US); Isaac B. Thomas, Carson City, NV (US)

(73) Assignee: Achates Power, Inc., San Diego, CA (US)

( * ) Notice: Subject to any disclaimer, the term of this patent is extended or adjusted under 35 U.S.C. 154(b) by 0 days.

(21) Appl. No.: 17/873,473

(22) Filed: Jul. 26, 2022

(65) Prior Publication Data

US 2023/0030878 A1 Feb. 2, 2023

Related U.S. Application Data

(60) Provisional application No. 63/227,656, filed on Jul. 30, 2021.

(51) Int. Cl.

| | |
|---|---|
| ***F01B 7/02*** | (2006.01) |
| ***F02B 75/28*** | (2006.01) |
| ***F02F 3/24*** | (2006.01) |
| ***F02F 3/28*** | (2006.01) |
| ***F02F 3/00*** | (2006.01) |
| *F02B 75/02* | (2006.01) |

(52) U.S. Cl.

CPC ..... *F02B 75/282* (2013.01); *F01B 7/02* (2013.01); *F02F 3/00* (2013.01); *F02F 3/24* (2013.01); *F02B 2075/025* (2013.01)

(58) Field of Classification Search

CPC ..... F01B 7/02; F02B 75/282; F02F 3/24
USPC ..... 123/51 B, 51 BA
See application file for complete search history.

(56) References Cited

U.S. PATENT DOCUMENTS

| | | | | |
|---|---|---|---|---|
| 4,090,479 | A * | 5/1978 | Kaye | F02B 31/00 123/306 |
| 5,211,101 | A | 5/1993 | Letsch et al. | |
| 5,245,913 | A * | 9/1993 | Kato | F16J 1/04 123/193.6 |
| 6,189,500 | B1 * | 2/2001 | Gyllenstedt | F02F 3/022 123/193.6 |
| 7,533,649 | B2 | 5/2009 | Kemnitz | |
| 8,020,530 | B2 | 9/2011 | Taylor et al. | |
| 8,783,218 | B2 * | 7/2014 | Shen | F02B 23/0675 123/55.2 |
| 9,982,715 | B2 | 5/2018 | Gorges et al. | |
| 10,030,604 | B2 * | 7/2018 | Montgomery | F02F 3/022 |
| 2005/0051128 | A1 * | 3/2005 | Kim | F02F 3/28 123/193.6 |
| 2016/0186685 | A1 | 6/2016 | Hirosawa et al. | |
| 2016/0341104 | A1 | 11/2016 | Redon | |
| 2020/0191090 | A1 | 6/2020 | MacKenzie | |
| 2020/0400021 | A1 | 12/2020 | Redon | |

FOREIGN PATENT DOCUMENTS

| | | |
|---|---|---|
| WO | 98/31929 | 7/1998 |

* cited by examiner

*Primary Examiner* — Erick R Solis
(74) *Attorney, Agent, or Firm* — Terrance A. Meador

(57) ABSTRACT

In an opposed-piston engine, a piston has a top land. The piston top land has a non-cylindrical shape which affords more clearance with a piston bore to thrust and anti-thrust sides than to front-facing and rear facing sides.

8 Claims, 2 Drawing Sheets

PISTON FOR AN OPPOSED-PISTON ENGINE

STATEMENT REGARDING FEDERALLY SPONSORED RESEARCH

This Project Agreement Holder (PAH) invention was made with U.S. Government support under Agreement No. W15KQN-14-9-1002 awarded by the U.S. Army Contracting Command-New Jersey (ACC-NJ) Contracting Activity to the National Advanced Mobility Consortium. The Government has certain rights in the invention

FIELD

The invention is in the field of internal combustion engines, which includes two-stroke cycle opposed-piston engines. In particular, the field concerns pistons of two-stroke cycle opposed-piston engines. The invention relates to configuration of the top land clearance of a piston of a two-stroke cycle opposed-piston engine.

BACKGROUND

An opposed-piston engine has at least one cylinder in the bore of which a pair of pistons is disposed for reciprocating movement with their end surfaces facing. During two-stroke cycle operation of the engine, the pistons move in opposing directions, with their end surfaces approaching each other to form a combustion chamber in the bore during a compression stroke, and moving away from each other during an expansion stroke. US Patent Publication 2016/0341104 describes an example of such an engine.

A piston of a two-stroke cycle opposed-piston engine comprises a tubular body with a basically cylindrical shape which is capped at one end by a crown. The crown comprises the end surface, which is configured to form a combustion chamber with the end surface of an opposing piston. The crown of each piston has a sidewall with a basically cylindrical shape related to the shape of the piston body, and comprises a circumferential side surface including an annular ring belt region in which one or more ring grooves are formed. Typically, there is a plurality of ring grooves in the ring belt region, spaced along a longitudinal axis of the piston. When the piston is vertically upright, the crown is at the top of the piston, and this this ring belt region may be referred to as the "top ring belt region", or as an "inner ring belt region". The ring groove closest to the end surface is the "top ring groove". A "top land" of this piston is the portion of the cylindrical side surface of the crown between the top edge of the top ring groove and the end surface. The top land meets the end surface at an edge. This edge defines a periphery of the end surface, and so is referred to as "the peripheral edge". US patent publication 2020/0191090 describes an example of such a piston.

The end surface comprises contour features that aid in mixing charge air and fuel. These features contain, shape, and locate the charge in preparation for ignition and combustion. One such feature includes a bowl partially or wholly recessed into the end surface. Injection trenches are formed in peripheral portions of the end surface to accommodate direct injection of fuel into the bowl. The fuel is injected from fuel injector nozzles acting through the sidewall of the cylinder. The injection trenches have shapes that guide fuel emitted by the fuel injectors. The fuel travels in predetermined directions into turbulent charge air in the combustion chamber formed between the bowl and a corresponding bowl in the end surface of an opposing piston. This type of piston is described, for example, in US patent publication 202/0191090 and US patent publication 2020/0400021.

In a diesel-fueled two-stroke cycle opposed-piston engine, carbon buildup on the top land of the above-type of piston has been observed frequently. After long run durations, a carbon deposit can build up on the top land to the point where it contacts the cylinder bore containing the piston. Due to a piston rocking motion, the deposited carbon can get packed on to the top land and form a hard, polished layer. The hard-packed deposit eventually starts to polish the cylinder bore, causing the surface texture of the bore to degrade. This can result in piston or ring scuffing. This type of bore polishing occurs as sides of the top land rock toward and away from the cylinder bore due to the piston rocking motion. If there is adequate clearance between the top land and the cylinder bore ("top land clearance"), the deposits tend to flake off without contacting the cylinder. Thus, simply increasing top land clearance would appear to be an effective technique for reducing top land carbon buildup. However, in a two-stroke cycle opposed-piston engine, increasing top land clearance can have a detrimental effect on engine performance. Greater top land clearance allows more "blowby", which refers to the escape of mass through intake and exhaust ports of the cylinder before they are sealed off by the rings. Trapped combustible mass is thereby reduced. Additionally, gas dynamics that aid combustion inside the combustion chamber formed between piston end surfaces are negatively affected by a greater top land clearance. The larger the top land clearance, the more trapped mass is allowed to escape the combustion chamber earlier during the expansion stroke, resulting in reduced work done on the opposed pistons.

In order to realize the benefits of an optimal top land clearance that obtains a desirable balance between good engine performance and high cylinder durability, it is important to consider the factor of piston response to thermal cycling. It is known that, during engine operation, a piston deforms in response to heat and engine dynamics. At the same time, and for the same reasons, the cylinder changes shape as well. In order to ensure a minimum clearance between the piston and the cylinder bore during engine operation, the tubular body of the piston may have an asymmetrical shape when cold that deviates from a full round cylindrical shape. Shaping the crown in a similar way presents the problem of carbon build-up on the top land.

PCT application SE/98/00056 describes a clearance solution for a diesel engine piston, in which a top land, when cold, has an oval shape in cross section with major and minor diameters, with the minor diameter being oriented in the longitudinal direction of the engine, and the major diameter being oriented in the transverse direction of the engine. This top land configuration provides a minimal top land clearance in the transverse direction of the engine. Given that the common orientation of the pistons of a diesel engine aligns the piston wristpins with the longitudinal direction of the engine, the minor diameter of the cold shape of the top land is in the plane of the wristpin. This orientation provides the lesser clearance along the sides of the top land which are orthogonal to the wristpin.

SUMMARY

Bore polishing in a diesel-fueled two-stroke cycle opposed-piston engine is more pronounced in the thrust and anti-thrust bore regions between which the top land of a piston rocks, because the rocking motion causes the carbon build-up on the top land to form into a hard, polished layer.

As the built-up hard carbon layer is less likely to flake off, it is desirable that the clearance between the top land and the thrust and anti-thrust regions of the cylinder bore be increased, the better to adapt the shape of the top land to reduce bore polishing by the hard carbon layer when the piston is hot. A solution is to provide a shape of the top land when the piston is cold that allows more clearance between the sides of the top land where carbon buildup occurs than the sides where less carbon buildup occurs when the piston is hot. This indicates the desirability of a greater top land clearance in the rocking direction. This rocking direction is transverse to the longitudinal direction of an opposed-piston engine of the type described, and therefore is orthogonal to the wristpin. Thus, the solution of PCT application SE/98/00056 is inapplicable.

Accordingly, there is a need for a shape of the top land of a piston for a diesel-fueled opposed-piston engine that, when cold, provides a clearance small enough to reduce blowby and also large enough to reduce or eliminate bore polishing caused by hard carbon buildup in the rocking direction of the top land.

An objective of the invention is to provide a piston for an opposed-piston engine in which top land geometry of the piston, while cold, enables a larger clearance in top land sides where packed carbon buildup occurs than in other top land sides where less, if any, packed carbon buildup occurs.

An objective of the invention is to provide a piston top land construction which, when the piston is hot, ensures that the clearance in the thrust and anti-thrust sides of the top land is similar to the clearance in the other sides of the top land.

These and other objectives of the invention are achieved with a piston for a diesel-fueled two-stroke cycle opposed piston engine having a top land with thrust and anti-thrust sides which are located with respect to a wristpin axis, in which the top land has a shape, when cold, comprising a combination of circular profiles oriented such that the thrust and anti-thrust sides of the top land have a smaller diameter than a diameter of other sides of the top land, thereby increasing the clearance of the thrust and anti-thrust sides of the top land to the cylinder bore with respect to the sides of the top land which have a larger diameter.

In a preferred embodiment of the piston, the circular profiles are oriented to define an approximately oval shape having a major axis and a minor axis, in which the major axis is longer than the minor axis. In some aspects, the shape may be an ellipse. In any case, the thrust and anti-thrust sides of the top land are aligned with the minor axis.

DETAILED DESCRIPTION

Figure 1:
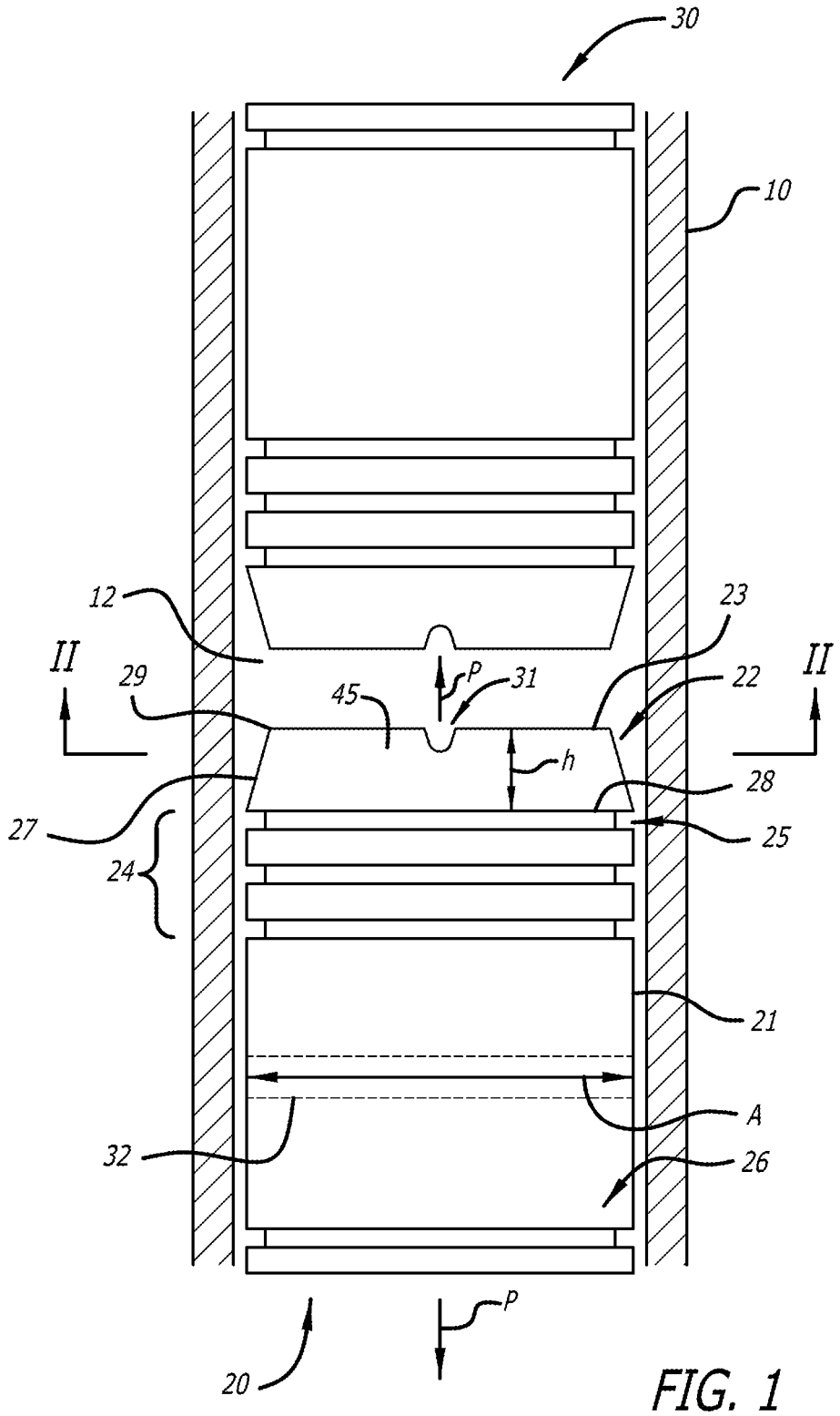
FIG. 1 is a schematic illustration showing a cut-away view of a pair of pistons in a cylinder of an opposed-piston engine in accordance with the invention.
Figure 2:
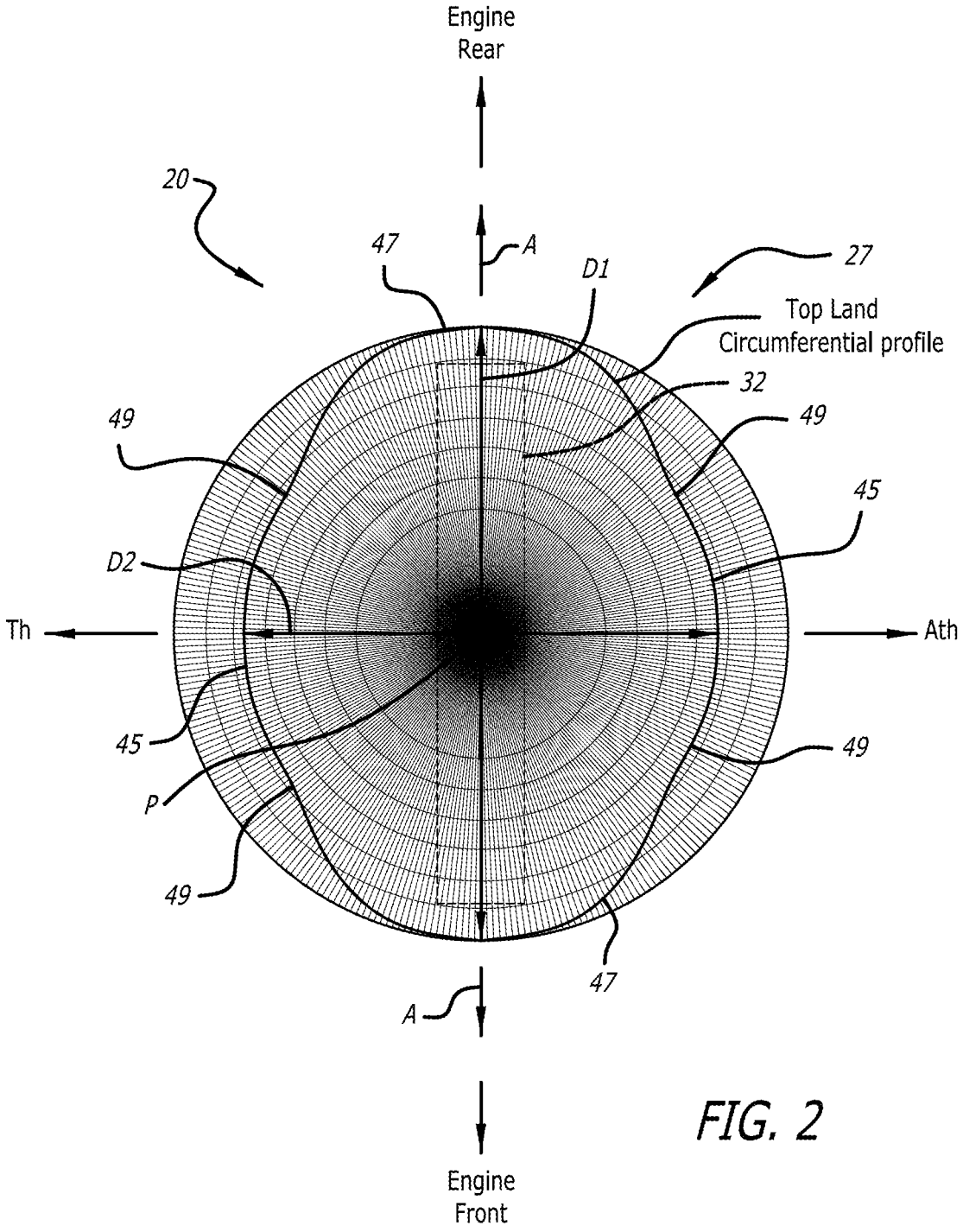
FIG. 2 illustrates a circumferential profile in a cross section taken along line II-II in FIG. 1.

The present invention is directed to a piston for a diesel-fueled two-stroke cycle opposed piston engine ("the opposed-piston engine"). FIG. 1 is a schematic illustration showing a cut-away view of a pair of pistons in a cylinder 10 of the opposed-piston engine, in accordance with the invention. FIG. 2 shows the shape of a circumferential profile of a top land 27 in a cross section taken along line II-II in FIG. 1. These figures are not to scale, and certain dimensions and shapes are exaggerated for clarification. In FIG. 1, 10 indicates a cylinder wall of a diesel-fueled two-stroke cycle opposed-piston engine, 12 indicates the bore of the cylinder, 20 indicates a first piston disposed in the bore 12, and 30 indicates a second piston disposed in the bore 12 in opposition to the first piston 20. Features common to both of the pistons are described with respect to the first piston 20, with the understanding that the piston 30 comprises these features as well. The piston 20 has a longitudinal axis P. 21 indicates a generally tubular body of the piston 20, which is capped at one end by a crown 22. The crown 22 comprises an end surface 23, which is configured to form a combustion chamber with the end surface of the piston 30. The base of the crown 22 has the general shape of the piston body 21. The crown 22 comprises a side surface including an annular ring belt region 24 in which at least one ring groove is formed. Typically, although not necessarily, there is a plurality of ring grooves in the ring belt region; three such ring grooves are shown as an example. Taking the crown 22 as the top of the piston 20, the ring belt region 24 is referred to as the "top ring belt region". The ring groove 25 closest to the end surface 23 is the top ring groove. The piston 20 has a lower ring belt region 26. The top land 27 of this piston is the portion of the side surface of the crown 22 between the top edge 28 of the top ring groove 25 and the end surface 23. The top land 27 meets the end surface 23 at an edge 29. This edge 29 defines a periphery of the end surface 23, and so is referred to as "the peripheral edge". An injector trench 31 opens through the peripheral edge 29. The piston body 21 includes a wristpin boss arrangement 32 configured to support a wristpin with an axis A. The top land 27 has the general appearance of a truncated cone of height h, which tapers slightly in radius from the top edge 28 of the top ring groove 25 to the peripheral edge 29.

FIG. 2 is a schematic illustration showing the shape of a circumferential profile of the top land 27 as it would be configured when the piston is cold, before the piston 20, the crown 22, and the top land 27 are deformed by heat and engine dynamics. The circumferential profile corresponds to the outline of a cross section of the top land 27 which is orthogonal to the longitudinal axis P of the piston 20. Representations of the wristpin boss arrangement 32 and the wristpin axis A, which are superimposed on the cross section, extend between an engine-front direction an engine-rear direction that define a longitudinal direction of the engine. Thrust (Th) and anti-thrust (Ath) directions are orthogonal to the engine-front direction and the engine-rear direction.

Referring to FIGS. 1 and 2, the top land 27 includes two sides 45 located on a thrust (Th) side and an anti-thrust (Ath) side of the wristpin boss arrangement 32. Two sides 47 of the top land 27 respectively face the engine-front direction and the engine-rear direction. As the piston 20 slides in the bore 12, it rocks on the wristpin axis A, tilting the Th side 45 of the top land toward the bore 12 during one stroke, and tilting the Ath side 45 of the top land toward the bore 12 during the following stroke. In this manner, carbon accumulating on the top land 27 is packed on the sides 45.

In order to mitigate the effects of carbon buildup on the sides 45, the circumferential profile of the top land 27 has an essentially oval shape, with a geometry which is described by a combination of circular and non-circular profiles, in which the engine rear and engine front sides 47 have a first circular profile with a diameter D1, the thrust and anti-thrust sides 45 have a circular profile with a diameter D2, and the diameter D1 is greater than the diameter D2, i.e., D1>D2. The sides 49 connecting the sides 45 and 47 are continuous, but non-circular. For example, the sides 49 may have a continuously-curved profile that smoothly connects the circular sides 45 and 47; in one embodiment, the sides 45 and 47 may have a double-sine (y=sin 2(x)) profile. In addition, a local relief around an injector trench may be summed with the circular and double sine profiles to create a net shape.

The smaller diameter D2 increases the clearance to the cylinder bore 12 along the thrust and anti-thrust sides 45 compared to the clearance to the bore 12 along the engine rear and engine front sides 47. Due to the piston rocking motion, the thrust and anti-thrust sides 45 typically get closer to bore 12 than the engine rear and engine front sides 47. With a non-cylindrical circumferential profile such as is seen in FIG. 2, it is possible to achieve a more uniform minimum top land clearance around the circumference of the top land over the engine cycle. That is, during engine operation, as the piston 20 deforms in response to thermal loading and engine dynamics, it rocks over between the thrust and anti-thrust directions, and circumferential profile in the thrust/anti-thrust directions can be designed such that the minimum clearance in the thrust/anti-thrust directions is similar to the minimum clearance in the engine-front and engine-rear directions by using a circumferential profile shape similar to what is shown in FIG. 2.

The invention claimed is:

1. A combination for an opposed-piston engine, comprising:

at least one cylinder;

a pair of pistons with end surfaces, which are disposed for reciprocating movement in a bore of the cylinder with their end surfaces facing;

each of the pistons comprising:

a tubular body with a wristpin boss arrangement;

the tubular body capped by a crown having an end surface configured to form a combustion chamber with an end surface of the other piston;

the crown having a top land with two first sides, respectively facing in a thrust direction and an anti-thrust direction, and two second sides, respectively facing in an engine-rear direction and facing in an engine-front direction;

in which thrust and anti-thrust directions are orthogonal to the engine-front direction and the engine-rear direction; and, in which the two first sides are configured to have a greater clearance with the bore than the two second sides.

2. The combination of claim 1, the crown comprising a ring belt region, wherein the top land is between the ring belt region and the end surface.

3. The combination of claim 2, the ring belt region comprising at least one ring groove, wherein the top land is between a top edge of the at least one ring groove and the end surface.

4. The combination of claim 1, the crown comprising a side surface including an annular ring belt region in which a plurality of ring grooves is formed, in which:

a top ring groove of the annular ring belt region is closest to the end surface;

the top land comprises a portion of the side surface between the top ring groove and the end surface; and the top land meets the end surface at an edge which defines a periphery of the end surface.

5. The combination of claim 4, wherein the annular belt region is a top belt region of the piston, the piston further comprising a bottom belt region.

6. The combination of claim 5, further comprising at least one injector trench opening through the peripheral edge and having a shape for guiding fuel injected into a bowl formed in the end surface.

7. The combination of claim 1, in which the two second sides have a circular profile with a diameter D1, the two first sides have a circular profile with a diameter D2, and the diameter D1 is greater than the diameter D2.

8. The combination of claim 7, in which the diameter D2 increases clearance to the cylinder bore along the thrust and anti-thrust sides compared to the clearance to the bore along the engine rear and engine front sides.

* * * * *